US006334583B1

(12) United States Patent
Li

(10) Patent No.: US 6,334,583 B1
(45) Date of Patent: Jan. 1, 2002

(54) PLANETARY HIGH-ENERGY BALL MILL AND A MILLING METHOD

(76) Inventor: Hui Li, 711 - 8888 University Drive, Burnaby BC (CA), V5A 1S6

( * ) Notice: Subject to any disclaimer, the term of this patent is extended or adjusted under 35 U.S.C. 154(b) by 0 days.

(21) Appl. No.: 09/513,131

(22) Filed: Feb. 25, 2000

(51) Int. Cl.[7] ..... B02C 17/14
(52) U.S. Cl. ..... 241/175
(58) Field of Search ..... 51/163.1; 241/175

(56) References Cited

U.S. PATENT DOCUMENTS

| | | | | | |
|---|---|---|---|---|---|
| 2,760,729 | A | * | 8/1956 | Mittag et al. | 241/175 |
| 3,524,735 | A | * | 8/1970 | Oetiker | 241/175 |
| 4,042,181 | A | * | 8/1977 | Huber et al. | 241/175 |
| 5,035,131 | A | | 7/1991 | Figge et al. | |
| 5,113,623 | A | | 5/1992 | Figge et al. | |
| 5,170,652 | A | | 12/1992 | Figge et al. | |
| 5,187,965 | A | | 2/1993 | Figge et al. | |
| 5,287,714 | A | | 2/1994 | Figge et al. | |
| 5,356,084 | A | | 10/1994 | Gamblin | |
| 5,375,783 | A | | 12/1994 | Gamblin | |

FOREIGN PATENT DOCUMENTS

| | | |
|---|---|---|
| CA | 2024120 | 8/1990 |
| CA | 2044658 | 7/1991 |

OTHER PUBLICATIONS

Chen, Shizhu "Research on Working Principle of a planetary High–energy Ball Mill" Mining and Metallurgical Engineer, V17 n4 Dec. 1997.

C.C. Koch "The Synthesis and Structure of Nanocrystalline Materials produced by Mechanical Attrition: A Review" Nanostructure Materials vol. 2 pp. 109–129, 1993.

* cited by examiner

*Primary Examiner*—Mark Rosenbaum

(57) ABSTRACT

A Planetary High-Energy Ball mill is for producing nano-sized powders and it includes: (a) a main axis which can not only rotate but also up and Down, (b) a roll-bearing to be fixed on nether end of the main axis, a revolvable plate to be fixed on the top of the main axis, and several able-swing shafts installed in the plate. (c) a plurality of planetary motion mill pots are fixed on the support canisters which are supported by able-swing shafts. (d) A stationary ring which is disposed coaxially with the main axis and serves as the orbit for mill pots. (e) impact bars on the bottom of mill pots using magnet technology to disperse doposited powders. The invention solves the problems of powders deposited on the bottom of mill pot, avoids tire ruption applied to private shaft which supports mill pots, improves stress distribution. So it capable for industrial-scale producing nanosized powders. The present invention also introduces a milling method for producing a wide variety of nano-scaled ceramic, metal and composite by selecting metal materials from the period table and the ceramic materials from the group of oxide, carbide, nitride, chloride, boride, silicide, sulfite etc.

10 Claims, 5 Drawing Sheets

PLANETARY HIGH-ENERGY BALL MILL AND A MILLING METHOD

BACKGROUND OF THE INVENTION

The present invention relates to an apparatus for producing nano-sized metal or ceramic powders, and more particularly, it relates to an apparatus for preparing a composite of metals and ceramics at a high production rate.

Nano-scale particles are known to exhibit unique physical and chemical properties. The novel properties of nano-crystalline materials are the result of their small residual pore sizes, limited grain sizes, phase or domain dimensions, and large fraction of atoms residing in interfaces. In multi-phase materials, limited phase dimensions could imply a limited crack propagation path if the brittle phase is surrounded by ductile phases, so the cracks in a brittle phase would not easily reach a critical crack size. Even with only one constituent phase, nano-crystalline materials may be considered as two-phase materials. The possibilities for reacting, coating, and mixing various types of nano-materials create the potential for fabricating new composites with nano-sized phases and novel properties. Not only is the structure different from those exhibited by their bulk counterparts, but also the mechanical, electronic, optical, magnetic and thermal properties of nano-crystalline materials are different from those exhibited by their bulk counterparts. Specifically, ceramics fabricated from ultra-fine particles are known to possess high strength and toughness because of their ultra-fine intrinsic defect sizes and the ability for their grain boundaries to undergo a large plastic deformation. Ultra-fine particles can be sintered at much lower temperatures also.

Known techniques for generating nanosized particles may be divided into four broad techniques, including: a vacuum technique, a gas-phase technique, a condensed-phase synthesis technique, and a mechanical grinding technique. The vacuum synthesis techniques includes sputtering, laser ablation, and liquid-metal ion source. Additionally, the gas-phase technique includes inert gas condensation, oven sources (for direct evaporation into a gas to produce an aerosol or smoke of clusters), laser-induced vaporization, laser pyrolysis, and flame hydrolysis. Furthermore, the condensed-phase synthesis technique includes reduction of metal ions in an acidic aqueous solution, liquid phase precipitation of semiconductor clusters, and decomposition-precipitation of ionic materials for ceramic clusters. Moreover, the mechanical grinding technique deals with a ball mill by which the powders in the mill pots can be ground into ultra-fine particles. Regardless of the technique used, most of these prior-art techniques suffer from a severe drawback: extremely low production rates. It is not unusual to find a production rate of several grams a day in a laboratory scale device. Vacuum sputtering, for instance, only produces small amounts of particles at a time. Laser ablation and laser-assisted chemical vapor deposition techniques are also well-known to be excessively slow processes. These low production rates, which generally result in high product costs, have severely limited the utility value of nano-phase materials. There is, therefore, a clear need for a faster, more cost-effective method for preparing nano-sized powder materials. Some processes require expensive precursor materials to produce ceramic powders and could result in a harmful gas. Most of the prior-art processes are capable of producing one particular type of metallic or ceramic powder at a time, but do not permit the preparation of a uniform mixture of two or more types of nano-scaled powders at a predetermined proportion. Also, most of the prior art processes require heavy and/or expensive equipment, resulting in high production costs. Additionally, during the precipitation of ultra-fine particles from the vapor phase, when using thermal plasmas or laser beams as energy sources, the particle sizes and size distribution can not precisely be controlled. Also, the reaction conditions usually lead to a broad particle size distribution as well as the appearance of individual particles having diameters that are multiples of the average particle size.

Prior art disclosures about mechanical grinding methods are as follows: U.S. Pat. No. 3,524,735 (Aug. 18, 1970), U.S. Pat. No. 5,356,084 (Oct. 18, 1994) and 5,375,783 (Dec. 27, 1994) by Rodger. L. Gamblin. U.S. Pat. No. 5,035,131 (Jul. 30, 1991), 5,113,623 (May 19, 1992), 5,170,652 (Dec. 15, 1992), 5,187,965 (Feb. 23, 1993), 5,287,714 (Feb. 22, 1994), Canadian Patent 2024120 (Aug. 28, 1990), 2044658 (Jul. 14, 1991) by Dieter Figge and Peter Fink. The U.S. Pat. No. 3,524,735 is similar to present invention in all these prior arts, but it's structure is simple and its producing efficiency is very low. Usually it needs more than 10 hours for preparing only several hundred grams of nanosized powders. For a review on this topic, two papers are refered: Chen, Shizhu, "Research on Working Principle of a Planetary High-energy Ball Mill" Mining and Metallurgical Engineer, V17 n4 December 1997. C. C. Koch, "The Synthesis and Structure of Nanocrystalline Materials Produced by Mechanical Attrition: A Review" NanoSTRUCTURE MATERIALS Vol. 2, pp. 109–129, 1993.

FIG. 1 is the schematic of the prior art U.S. Pat. No. 3,524,735. A small drive rotating pulley 2 is connected to a motor 1 and receives rotational forces therefrom. These rotational forces are transmitted from a small pulley 2 to a large pulley 4 through a belt 3. Mill pots 7 are held symmetrically on a rotary turntable 5. This rotary turntable, also referred to as the main shaft, is mounted on the same rotary shaft as the large pulley 4. The central rotary shaft 6 of each mill pot 7 forms a revolving pair with the turntable 5. The bottom end of the shaft 6 is connected to and supported by a planetary pulley 9. The pulley 9 corresponding to each mill pot is connected to a central pulley 8 through a belt based transmission system, forming a planetary motion pair. The central pulley 8 is disposed coaxially with the large drive pulley 4 and the turntable 5 on the same base. The two drive pulleys 4, 5 and the auxiliary central pulley 8 share a common central axis. When starting the motor 1, the turntable 5 will rotate and all the mill pots will undergo a primary revolving motion surrounding the central axis, at the same time, each mill pot 7,working congruently with the auxiliary pulley 8, will make a planetary motion. In this vertical style ball mill, each mill pot 7 not only revolves about an axis of the main shaft, but also revolves around its own axis. The producing efficiency of this conventional high-energy planetary ball mill is very low. Additional problems exist with respect to this conventional ball mill, including the following: First, the pivot shaft to support mill pot is revolvable and cantalevered, so the root of the pivot shaft bears the majority of the stress, which may result in a tire rupture of the pivot shaft and limit the rotating speed of this ball mill. Second, due to the mill pots being positioned upright, the powdered particles will deposit on the bottom of the mill pots and substantially prevent the particles from being fined continuously.

If the power and efficiency of the ball mill can be significantly improved, mechanical grinding methods can become a mass production method for preparing nano-scaled powders. The present invention is a reasonable high energy planetary ball mill (see FIG. 2, FIG. 3, FIG. 4 and FIG. 5).

SUMMARY OF THE INVENTION

A preferred embodiment of the present invention is a planetary high-energy ball mill for producing nanometer-scale powders. This ball mill is composed of the following major components: a vertical main shaft that is revolvable and glide-able up or down, a turntable fixed on the top of a main shaft, a plurality of mill pots fixed inside the cup-like rollers, wherein the rollers are rotatably supported by the swing-able pivotal shaft, a stationary ring which is disposed coaxially with the main shaft, a transmission screw for driving a clamp, and two motors for driving the main shaft and transmission screw, respectively.

When the main shaft is rotated by the main motor via the gear pair, the turntable will rotate too, and the cup-like rollers will be pushed to touch the stationary ring due to the centrifugal force. The cup-like rollers can also rotate about their own axis due to the friction counterforce received from the stationary ring. In this invention, a cup-like roller is not only revolvable around its own axis, but also revolvable around the main shaft, such that the mill pots fixed inside the cup-like rollers are in emblematical planetary motion. Because this planetary movement of the mill pots, the particles in the mill pots can be ground to ultra-fine powders. These fine powders will deposit on the bottom of the mill pots after the ball mill works several hours. This is a general problem for the ball mill with upright mill pots, wherein the thick deposited powders will stymie the powders in the mill pots to be fined sequentially. In this invention, after the ball mill works for several hours, the main shaft will be operated to rotate slowly, and a screw driving means will drive the main shaft up until the cup-like rollers approach a horizontal position, then each cup-like roller, as well as the mill pot, will rotate on the top of the stationary ring. Several magnetizer impacting poles, which are inserted into a corresponding hole of the cup-like roller, may be attracted to or repelled from a magnet fixed under the turntable periodically. When a magnetizer impacting pole is near the magnet, a spring will be compressed, alternatively, when a magnetizer impacting pole is away from the magnet, the magnetizer impacting pole will impact the bottom of the mill pot by the elasticity of the spring. It is the frequent impact that disperses the deposited powders. After the deposited powders are dispersed, the main shaft will be operated to move down till the axis of the mill pots are upright, and then the ball mill will be operated to rotate in faster speed. It is possible to repeat above up and down process several times, the powders in the mill pots will be ground into nanoscale, and further, the mechanical alloying or the composite will be realized.

Advantages of the present invention may be summarized as follows:

(1) In present invention, first, each swing-able pivotal shaft by which the cup-like roller is rotatably supported is a two-points supported beam in mechanics, so its stress distributing can be improved compared to the prior art in which the pivotal shaft is a cantalever beam. Second, because the swing-able pivotal shaft can not rotate about its own axis, the tire rupture phenomenon of the swing-able pivotal shaft will be avoided. Therefore the present invention can be operated to rotate faster, resulting in the powders in the mill pots being crushed by the balls at higher frequency and stronger crushing force than prior art. Because of the above-mentioned benefits, the present invention can be used to produce nanosized powders at industrial level.

(2) In present invention, the powders deposited on the bottom of the mill pots can be dispersed by the impacting poles when the mill pots lay at horizontal position. This is propitious to fine the powdered particles continuously till nano-scale.

(3) A variety of nano-scaled ceramic, metal and mechanical alloying or composite which are comprised of ceramics and metals, can be readily produced by using present invention. The metal materials can be selected from the period 1*c* table, and the ceramic materials can be selected from the group consisting of oxide, carbide, nitride, chloride, boride, silicide, sulfite and so on.

DETAILED DESCRIPTION OF THE INVENTION

Figure 1:
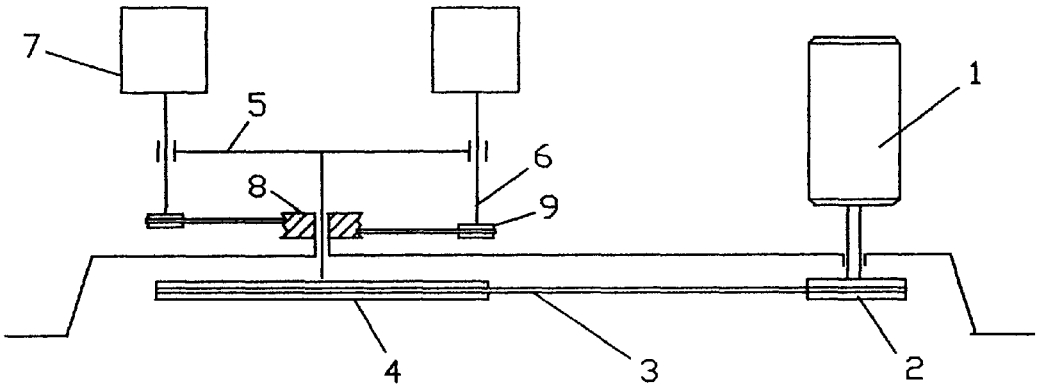
(Prior Art) FIG.1
FIG. 1 A schematic sketch of a conventional planetary ball mill (prior art).
Figure 2:
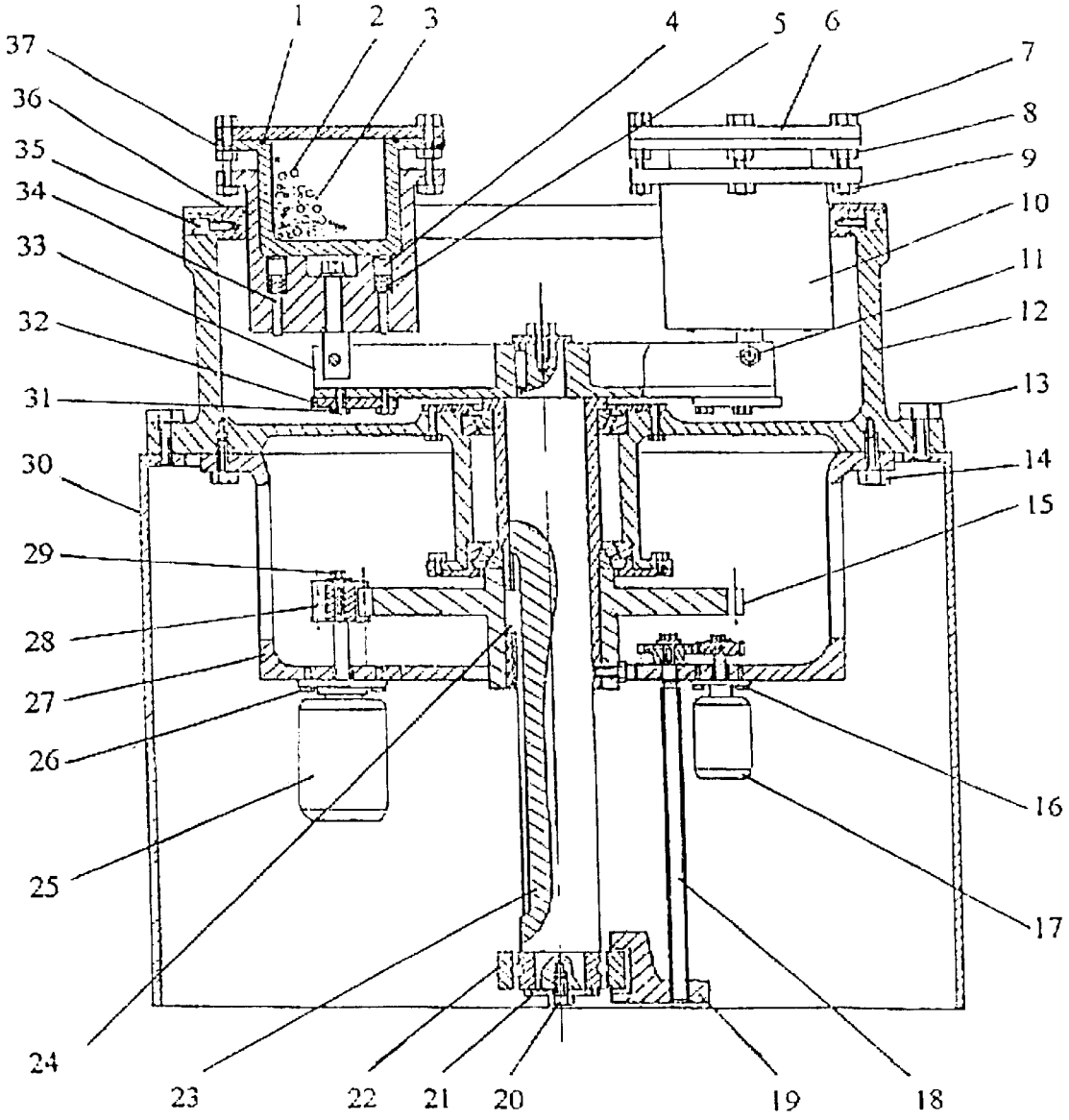
FIG. 2 Working situation when the main shaft is at the regular position.
Figure 3:
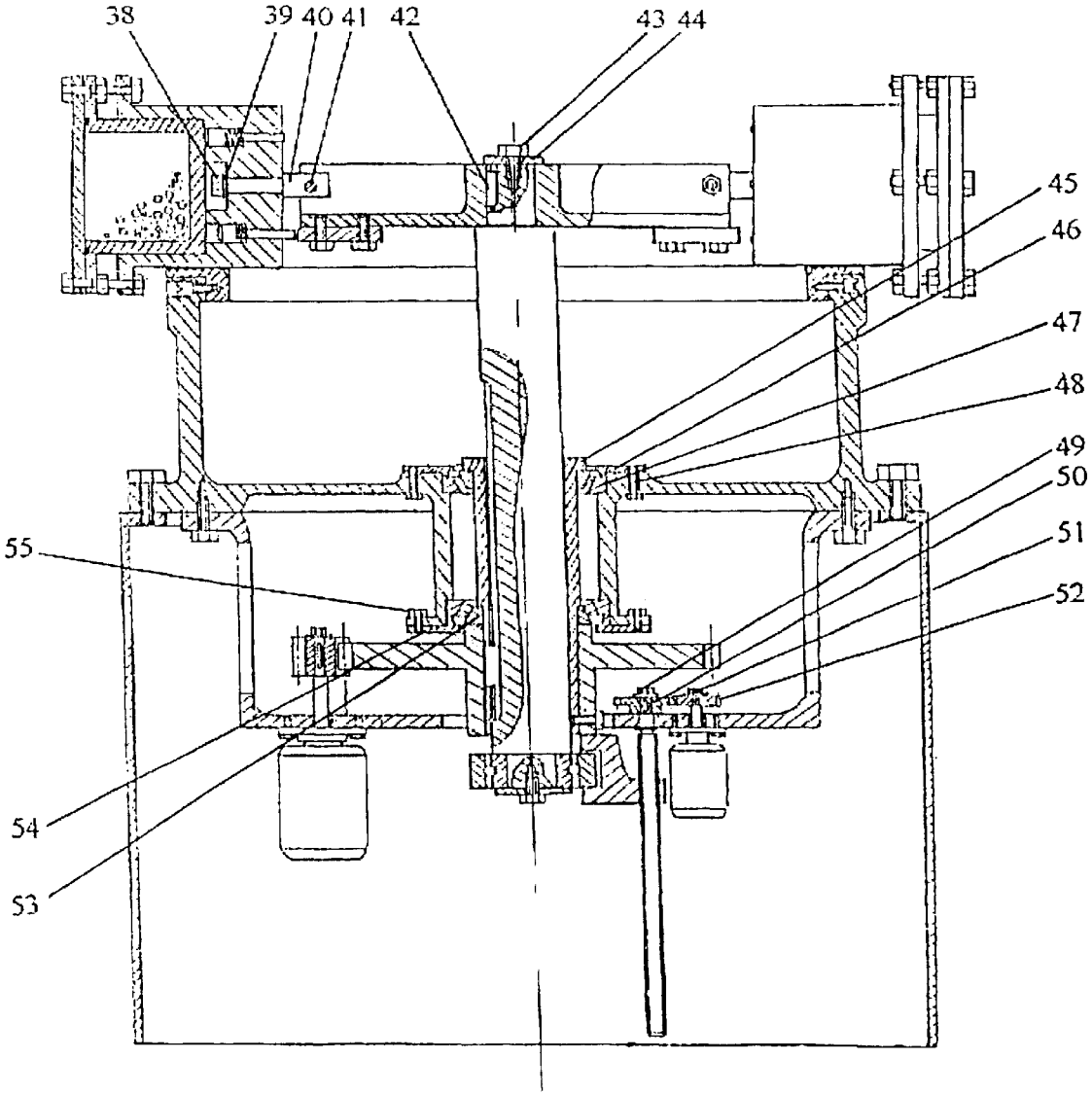
FIG. 3 Working situation when the main shaft is up to the highest position.

In order to illustrate how the present invented planetary ball mill differs from the conventional one, a detailed analysis follows:

FIG. 2 and FIG. 3 show the present invented high-energy planetary ball mill. In the present invention, when the main motor 25 works, the main shaft 23 and sleeve 45 will be driven to rotate at the same speed by gear pair 28, 15 and key 24. The main motor 25 is fixed on the shelf 27 by the bolts 26, the gear 28 is fixed on the shaft of the main motor by the bolt 29. The main shaft 23 has more than one long keyway. A turntable 33 is fixed on the top of the main shaft 23 by the key 42, the bolt 43 and the washer 44. When the auxiliary motor 17 works, the screw 18 will rotate via gear pair 50, 52, so the clamp 19, by which a ball bearing 22 is clamped, will be driven up or down. As such, the main shaft 23 will be driven up or down inside the sleeve 45 while the main shaft 23 and the sleeve 45 are rotating at the same speed. The bolt 20 and the washer 21 are for fixing the ball bearing 22, and the bolts 49, 51 are for fixing gear 50 and 52, respectively. The shelf 27 is fixed on the annular shell 12 by the bolt 14, and the shell 12 is fixed on a standing seat 30 by the bolts 13. The sleeve 45 is fixed in the inside ring of ball bearing 47, 53, the outside ring of the ball bearing 47, 53 is mounted into the annular shell 12, the cover 46, 54, which are used to substantially prevent the ball bearing 47, 53 from moving up or down respectively are fixed on the annular shell 12 by the bolts 48, 55. A stationary ring 36 may be disposed coaxially with the main shaft 23, and may be fixed on the shell 12 by the bolts 35. A plurality of mill pots 37 are fixed to corresponding cup-like rollers 10 with impacting poles 4. The cup-like roller 10 is rotatably supported by the swing-able pivotal shafts 40. The swing-able pivotal shaft is comprised of two sections: one end of the swing-able pivotal shaft is columniform in shape for rotatably supporting the cup-like roller 10, and the other is quadrate in shape for connecting the corresponding quadrate groove on the turntable 33 via the pin 41 and the nut 11, these quadrate grooves are distributed averagely on the turntable. Each cup-like roller 10 is rotatably supported by a swing-able pivotal shaft, which implies that the outside diameter of the columniform of the swing-able pivotal shaft 40 is less than the inside diameter of the larger central hole of the cup-like roller 10.

The nut 38 and washer 39 are used to keep the cup-like roller 10 away from swing-able pivotal shaft.

As FIG. 3 shows, when the main shaft is lifted to the top, these cup-like rollers 10 will approach a horizontal position. Because the cup-like rollers 10 roll on the ring 36 about their own private shaft continuously, the iron impacting poles 34, which are disposed around larger central holes of cup-like roller 10, will approach and leave the magnet 32 periodically. When the iron impacting poles 34 approach the magnet 32, the iron impacting poles 34 will be attracted by the magnet 32 to resist the elasticity of the spring 5 (the spring will be compressed), when the iron impacting poles 37 leave the magnet 32, the spring will force the iron impacting poles 37 to impact the bottom of the mill pot 37, which is fixed inside cup-like roller 10. Because the iron impacting poles 34 impact the bottom of the mill pot 37 frequently, these powders on the bottom will be dispersed. When the main shaft 23 moves down, these dispersed powders can be continuously fined by balls 2. Bolts 7, nut 8, 9 are used for fixing the cup-like roller 10, mill pots 37 and the cover 6 together.

Figure 4:
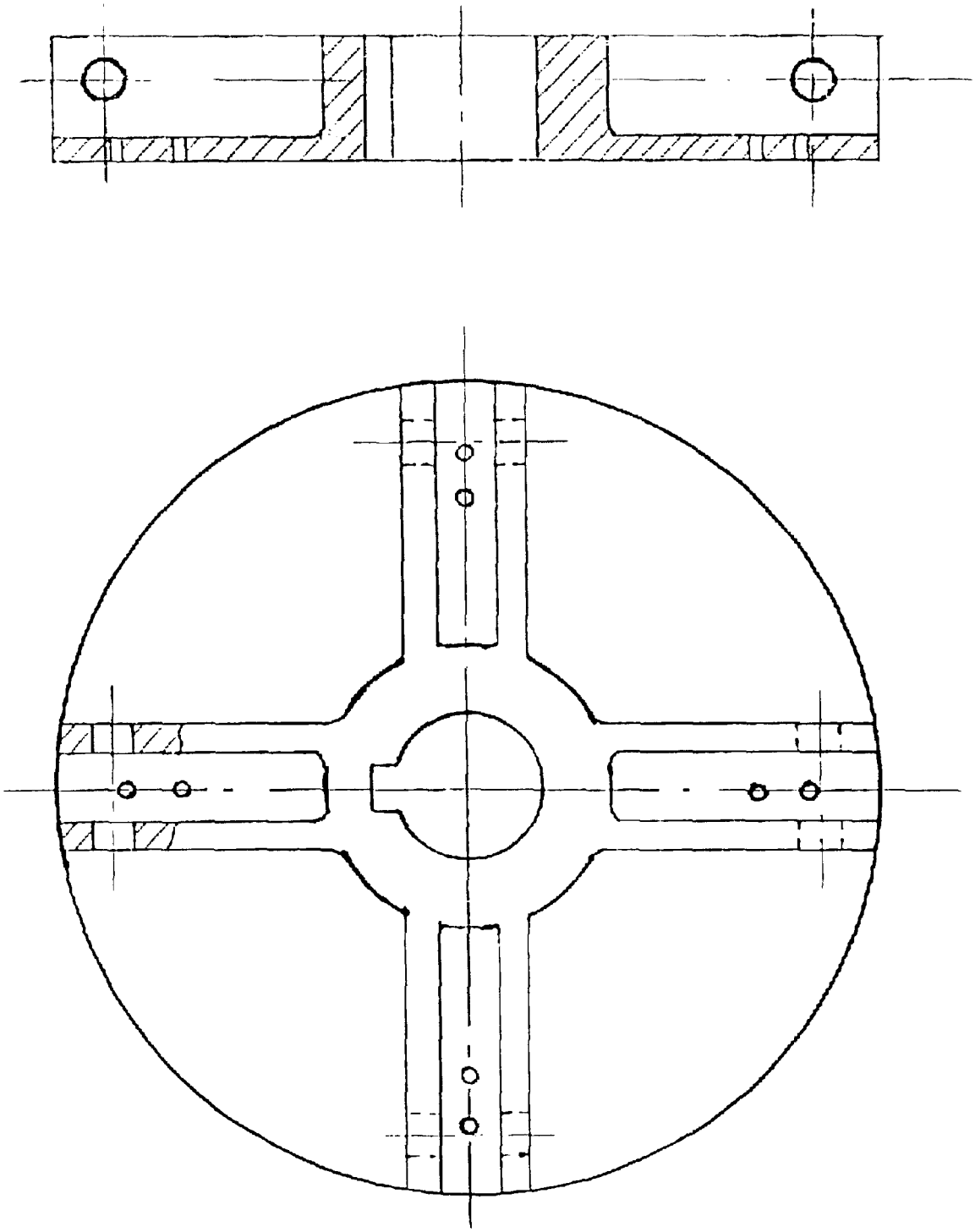
FIG. 4 The figure of the turntable.

FIG. 4 is the figure of the turntable. Its characteristic is that there are more than one quadrate grooves for installing the swing-able pivotal shafts on the turntable. As illustrated, the grooves are disposed on the turntable with equal distance between each other. Quadrate grooves permit the swing-able pivotal to only be swing-able but never rotatable.

Figure 5:
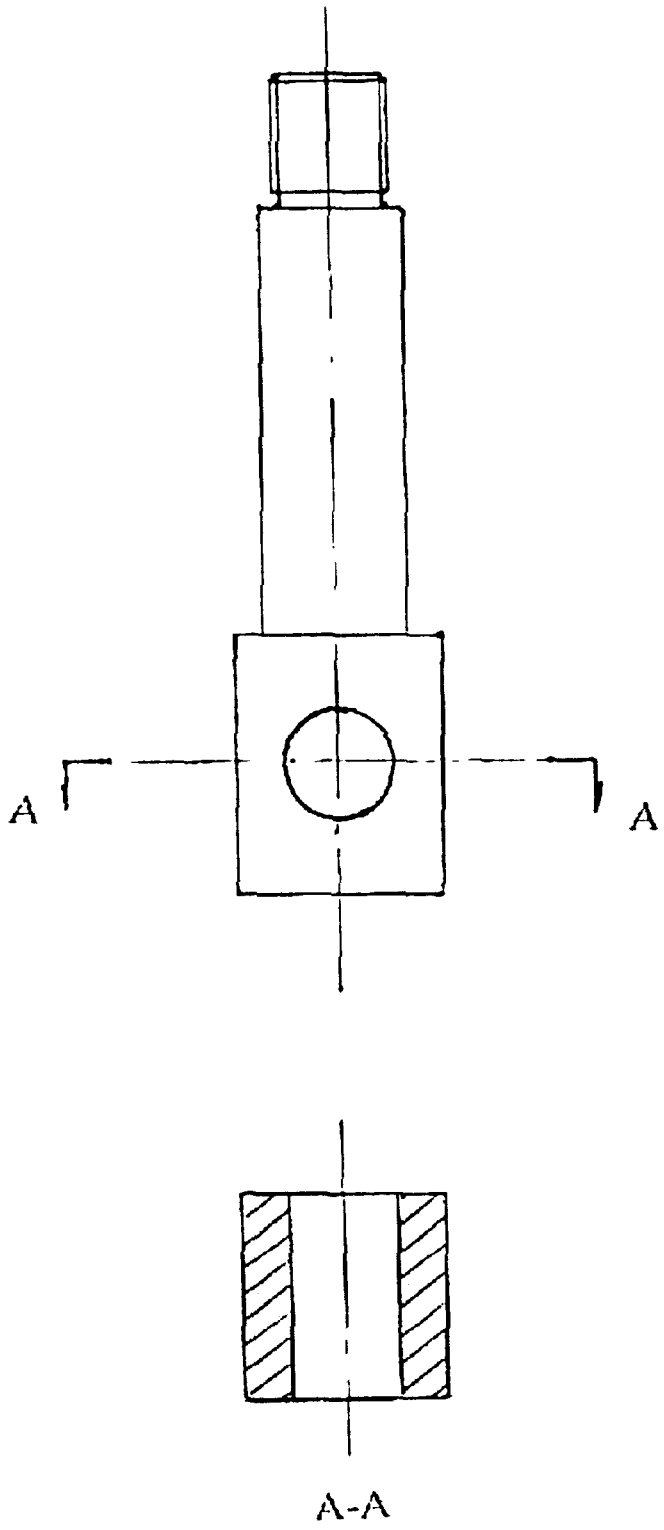
FIG. 5 The figure of the swing-able pivotal shaft.

FIG. 5 is the figure of the swing-able pivotal shaft. As illustrated, each swing-able pivotal shaft may be comprised of two sections, one end of the swing-able pivotal shaft is columniform in shape for rotatably supporting the cup-like roller 10, and the other is quadrate in shape for connecting with the corresponding quadrate groove on the turntable 33.

As for the operation of this invention, the important process is that after the main motor works for several hours, the main shaft must be operated to rotate slowly, then starting the auxiliary motor, then the clamp will lift the main shaft up until the cup-like roller 10 approaches the horizontal position, and each cup-like roller 10 will rotate on the top of the stationary ring in lower speed. After the powders, which deposited on the bottom of mill pots, are dispersed by impacting poles, the main shaft will be operated to move down till the axis of the ball mills are upright, and then the ball mill will be operated to rotate in faster speed, wherein the powders will be ground finer. It is possible to repeat the above-mentioned process several times, so the powders in the mill pots will be ground into nanoscale, and further, the mechanical alloying or the composite will be realized.

What is claimed is:

1. A planetary high-energy ball mill for producing nanometer-scale powders, comprising:

(a) a vertical main shaft that is revolvable and glide-able up or down;

(b) a turntable fixed on a top of said main shaft;

(c) at least two un-magnatized cup-like rollers, a mill pot fixed with said cup-like rollers, said cup-like rollers operable to rotate about their own swing-able pivotal shafts while rotating in unison about said main shaft, said cup-like rollers self-rotated due to friction counterforce received from a stationary ring, said cup-like rollers disposed around said turntable with substantially equal distance between one another, wherein said cup-like rollers are rotatably supported by said swing-able pivotal shafts;

(d) said stationary ring disposed coaxially with said main shaft; and (e) an inside ring of a ball bearing fixed at a bottom of said main shaft, wherein an external ring of said ball bearing is clamped by a clamp, said clamp driven by a transmission screw for driving said main shaft up or down.

2. An apparatus as set forth in claim 1, wherein said main shaft includes one or more long keyways located parallel to an axis of said main shaft.

3. An apparatus as set forth in claim 1 or 2, further comprising a main motor configured to drive said main shaft using gear transmission means and key connect means.

4. An apparatus as set forth in claim 1, wherein said turntable includes more than one quadrate grooves for mounting said swing-able pivotal shafts, and wherein a middle plane of said more than one quadrate grooves is radial to said main shaft, and said more than one quadrate grooves are disposed symmetrically.

5. An apparatus as set forth in claim 1, wherein an inside track of said stationary ring is circular in shape, a measure of said inside track is equal to an excircle of said cup-like rollers when said cup-like rollers are in a vertical position and a top track of said stationary ring is horizontal.

6. An apparatus as set forth in claim 1, wherein said cup-like rollers 10 are rotatably supported by said swing-able pivotal shafts using ball bearing means.

7. An apparatus as set forth in claim 1, wherein upper parts of each of said cup-like rollers have space for fitting said mill pot, lower parts of each of said cup-like rollers have more than two T-type holes disposed around an axis of said cup-like rollers with equal distance between one T-type hole and another, wherein an excircle of said T-type holes is smaller than an outside diameter of a bottom of said mill pot, and wherein a magnetize impact pole and a spring are inserted into each of said T-type holes.

8. An apparatus as set forth in claim 7, further comprising a magnet mounted proximate said impact pole such that said impact pole can be attracted.

9. An apparatus as set forth in claim 1, wherein said swing-able pivotal shafts can not rotate when said main shaft slides from bottom to top, said swing-able pivotal shafts will change from a vertical position to a horizontal position smoothly when said main shaft slides from said top to said bottom, and said swing-able pivotal shafts will change from said horizontal position back to said vertical position smoothly.

10. An apparatus as set forth in claim 1, further comprising an auxiliary motor configured to move said main shaft up or down using gear transmission means and said screw driving means, while said external ring of said ball bearing is clamped by said clamp.

* * * * *